US011363936B2

(12) United States Patent
Fey et al.

(10) Patent No.: US 11,363,936 B2
(45) Date of Patent: Jun. 21, 2022

(54) DISHWASHER HAVING AT LEAST ONE WATER FEED

(71) Applicant: BSH Hausgeräte GmbH, Munich (DE)

(72) Inventors: Janina Fey, Munich (DE); Michael Plank, Munich (DE); Alf Hackenberg, Munich (DE)

(73) Assignee: BSH Hausgeräte GmbH, Munich (DE)

( * ) Notice: Subject to any disclaimer, the term of this patent is extended or adjusted under 35 U.S.C. 154(b) by 73 days.

(21) Appl. No.: 16/495,529

(22) PCT Filed: Mar. 8, 2018

(86) PCT No.: PCT/EP2018/055716

§ 371 (c)(1),
(2) Date: Sep. 19, 2019

(87) PCT Pub. No.: WO2018/172083

PCT Pub. Date: Sep. 27, 2018

(65) Prior Publication Data

US 2020/0008645 A1 Jan. 9, 2020

(30) Foreign Application Priority Data

Mar. 20, 2017 (DE) ..... 10 2017 204 624.4

(51) Int. Cl.

| | |
|---|---|
| ***A47L 15/16*** | (2006.01) |
| ***A47L 15/42*** | (2006.01) |
| ***A47L 15/50*** | (2006.01) |

(52) U.S. Cl.

CPC ..... *A47L 15/4246* (2013.01); *A47L 15/16* (2013.01); *A47L 15/428* (2013.01); *A47L 15/4219* (2013.01); *A47L 15/50* (2013.01)

(58) Field of Classification Search

None

See application file for complete search history.

(56) References Cited

U.S. PATENT DOCUMENTS

| | | | |
|---|---|---|---|
| 2003/0010113 | A1 | 1/2003 | Rosenbauer |
| 2011/0215689 | A1 | 9/2011 | Wegener |
| 2014/0230865 | A1 | 8/2014 | Rehm |
| 2015/0208897 | A1 | 7/2015 | Kangas |

FOREIGN PATENT DOCUMENTS

| | | | |
|---|---|---|---|
| EP | 2366323 | A1 | 9/2011 |
| JP | 2005143881 | A | 6/2005 |

OTHER PUBLICATIONS

International Search Report PCT/EP2018/055716 dated Apr. 18, 2018.

National Search Report CN 2018800200659 dated Dec. 24, 2021.

*Primary Examiner* — Levon J Shahinian

(74) *Attorney, Agent, or Firm* — Michael E. Tschupp; Andre Pallapies; Brandon G. Braun

(57) ABSTRACT

A dishwasher includes a dishwasher cavity configured to receive an item to be washed. A water feed extends completely or partially in the dishwasher cavity for providing a water distribution in the dishwasher cavity. Associated with the water feed is a lighting device having a lighting line extending along a guiding direction of the water feed.

12 Claims, 8 Drawing Sheets

DISHWASHER HAVING AT LEAST ONE WATER FEED

CROSS-REFERENCES TO RELATED APPLICATIONS

This application is the U.S. National Stage of International Application No. PCT/EP2018/055716, filed Mar. 8, 2018, which designated the United States and has been published as International Publication No. WO 2018/172083 A1 and which claims the priority of German Patent Application, Serial No. 10 2017 204 624.4, filed Mar. 20, 2017, pursuant to 35 U.S.C. 119(a)-(d).

BACKGROUND OF THE INVENTION

The present invention relates to a dishwasher, in particular household dishwasher, having a dishwasher cavity for receiving items to be washed and at least one water feed extending completely or partially therein for a water distribution means arranged in the dishwasher cavity, in particular in the upper half of the dishwasher cavity.

Various approaches are known for improving convenience for the customer and the quality impression of a dishwasher by providing the dishwasher with interior lighting in the dishwasher cavity. This also enables the items to be washed to be checked for cleanliness. A problem here is that such lighting generally requires one or more openings in one or more walls of the dishwasher cavity for its contacting and/or mechanical mounting, so that special sealing measures become necessary. As a result, the total outlay for such lighting is significant. Furthermore, such light sources are often only isolated and point-shaped, which produces shadowing effects and highlights.

The problem underlying the invention is that of achieving an improvement here.

BRIEF SUMMARY OF THE INVENTION

The invention achieves the object with a dishwasher having a dishwasher cavity for receiving items to be washed and at least one water feed extending completely or partially therein for a water distribution means arranged in the dishwasher cavity, in particular in the upper half of the dishwasher cavity, wherein at least one lighting device is associated with the water feed.

With regard to further advantageous embodiments and features of the invention, reference is made to the dependent claims.

By at least one lighting device being associated with the section of the water feed extending in the interior of the dishwasher cavity in the dishwasher, in particular household dishwasher according to the invention, a lighting and/or illumination and/or light design is provided in a simple manner in the interior of the dishwasher. It can be advantageous in particular if the lighting device is attached to the water feed or water feed device, preferably integrated therein. This facilitates the installation work during assembly of the dishwasher.

In the dishwasher according to the invention, according to an advantageous development at least one lighting line is associated with the water feed or water feed device disposed in the dishwasher cavity and leading to a water distribution means along its water guiding direction. As a result, a uniform illumination over the extent of the water feed can be achieved without the need to provide special openings for the lighting in the walls of the dishwasher. The outlay is therefore low. It is nevertheless possible to achieve a preferably large-area, in particular homogeneous illumination of the interior of the dishwasher cavity with a correspondingly high luminosity of the lighting line. With a lower luminosity, on the other hand, the lighting line radiates light at least as a light design element.

According to an advantageous development of the invention, the water feed or water feed device in the dishwasher cavity extends in particular from the floor region thereof to a water distribution means or water distribution device disposed in the upper half of the dishwasher cavity. It extends preferably on the rear wall, in particular along the center axis thereof from bottom to top. At least one lighting line is associated with this upwardly extending water feed. A lighting line is advantageously provided on each side of the upwardly extending water feed following the course thereof. In particular, the water feed comprises at least one closed channel extending in certain regions, in particular in an upward direction, along an upright wall of the dishwasher cavity, which channel can be used for the lighting. This channel preferably extends from below, in particular from the floor of the dishwasher cavity, into the upper half of the dishwasher cavity, so that it thereby offers a greater extension path for one or more lighting devices. In the respective channel itself, washing fluid can be guided to and through the water distribution means, in other words the water distribution device.

The channel provided for guiding washing fluid in each case can in particular take the form of a tube. It can be particularly advantageous if the water feed device comprises two channels, of which one leads to an upper, rotatably mounted spray arm and the other to a spray device such as a shower on the roof of the dishwasher cavity. These two channels are expediently integrated in the form of tubes side by side in a common plastic component which is in particular formed in one piece and preferably of one material.

It can be particularly favorable if symmetrical lighting which radiates light on both sides of the channel is provided. This embodiment is advantageous in particular if the water feed extends symmetrically in a transverse center of the dishwasher cavity. It is particularly advantageous if the water feed extends along the vertical center axis of the rear wall of the dishwasher cavity.

In particular, two lateral lighting lines are arranged for this purpose symmetrically on two opposing sides of the water feed, each of which must illuminate only the region from there to a side wall of the dishwasher cavity, in other words must illuminate a path of less than 30 centimeters given a total width of approximately 60 centimeters.

Here, the lateral lighting lines advantageously radiate light in the transverse direction toward the two lateral sides or side walls of the dishwasher cavity of the dishwasher according to the invention, and do not dazzle a user looking into the dishwasher cavity from the front. Here, the transverse direction extends to the left and right from the viewpoint of a user standing in front of the dishwasher. The width of the dishwasher cavity extends along the transverse direction. The direction extending toward the user, which points to the front of the dishwasher, is perpendicular to the transverse direction. Against this direction pointing to the front, the depth of the dishwasher extends from front to back.

The lateral lighting lines following the guiding direction of the water can be connected to one another above the water distribution means via an upper terminating line, so that light radiation can be produced not only in the transverse direction but also in the upward direction. This light radiation, too, is preferably indirect.

The end of the water feed device facing away from the water distribution means is in particular connected directly to an output of the circulating pump of the dishwasher or to an output of a water switch which is connected to an output of the circulating pump of the dishwasher. The circulating pump and, if present, the water switch are expediently accommodated below the floor of the dishwasher cavity in a base support or base of the dishwasher. During operation of the circulating pump, washing fluid is pumped by the circulating pump into this end of the water feed device facing away from the water distribution means and guided to the water distribution means via the one or more feed channels of the water feed device. The end of the water feed device facing away from the water distribution means is preferably connected directly via a passage in the floor of the dishwasher cavity or indirectly via the water switch, if present, to the circulating pump.

In particular, the water feed device can be composed of a longitudinal section on the floor side of the dishwasher cavity and, connected thereto, a longitudinal section on the rear wall side. The water feed thus has an L shape. The longitudinal section of the water feed device on the floor side of the dishwasher cavity preferably extends essentially horizontally backward from a fluid feed point, which is provided in particular approximately in the center of the dishwasher cavity floor or at another point in the floor of the dishwasher cavity, underneath which or in the vicinity of which the output of the circulating pump or the output of a water switch downstream of the circulating pump is arranged, along the center axis of the dishwasher cavity floor to the rear wall of the dishwasher cavity. The longitudinal section of the water feed device on the rear wall side, on the other hand, extends preferably essentially vertically upward from the floor of the dishwasher cavity on the rear wall thereof to the upper water distribution device. In particular it can be advantageous here if the longitudinal section on the rear wall side extends along the center axis of the rear wall.

Particularly good, continuous esthetics are achieved here if the lateral lighting lines and the upper terminating line form a common, complete lighting line surrounding the water feed in certain regions. By the light radiating toward the sides and upward, the entire rear wall outside of the water feed can thus be illuminated and can then also reflect forward if the dishwasher cavity is embodied from stainless steel.

In addition or independently herefrom, the two lateral lighting lines can also be connected to one another at the end of the water feed or water feed device facing away from the water distribution means via a transversely extending connecting portion which is also embodied as a lighting line.

For uniform lighting which at the same time takes up only little space, at least one of the lighting lines can comprise in particular a plurality of light-emitting diode (LED) light sources, for example also in the form of pre-assembled light cords. In addition or alternatively, light guides which radiate light to the side are possible. Light sources other than LED light sources are naturally also possible.

As well as the high efficiency and the small installation space required, the use of LEDs offers the further advantage that the color of the lighting lines can be selected individually.

A particularly space-saving embodiment involving minimal outlay provides that the lighting line(s) is or are arranged in an intermediate space between the channel and a wall of the dishwasher cavity. If the channel is provided on the rear wall of the dishwasher cavity on the interior side, the extent of the intermediate space in the depth direction in front of the rear wall can be very slight.

Here, the lighting line(s) itself or themselves can be hidden by the channel and thus not visible from the front so as to produce particularly elegant indirect lighting which furthermore requires only minimal installation space.

The lighting line(s) can be arranged in a watertight plastic body, in particular resistant to washing liquor, which shields the lighting line(s) from splashing water in the dishwasher cavity. The plastic body is preferably provided on, in particular molded onto the rear side of the water-guiding channel of the water feed device facing the wall, in particular rear wall, of the dishwasher cavity to which the channel is attached on the interior side of the dishwasher cavity. Here, the plastic body can have in particular an empty channel on the rear side, in which the one or more lighting lines are accommodated and which is sealed in a watertight manner by means of a cover or lid on the rear side. Alternatively or in addition, the one or more lighting line(s) can be cast in a watertight manner, in particular in a plastic material which is preferably resistant to washing liquor.

Where applicable, it can also be expedient if, instead of the one or more lighting lines such as 17, 18, a lighting device with a spatial-geometric shape which differs from a line is associated with the water feed, in particular is attached thereto. Here, the lighting device can be provided for example in the form of a flat, for example circular or rectangular lighting panel at a height position on the upward water feed disposed in the vacant gap between a lower basket provided close to the dishwasher cavity floor and an upper basket arranged further up in the dishwasher cavity at a vertical distance from the lower basket. According to a further advantageous variant, the lighting device can form an illuminated surface section on the upper side of the water feed which is visible to the user. In particular, the lighting device can form an illuminated surface section on the front side which is directly visible from the front on the vertically extending section of the upward water feed.

Other developments of the invention are disclosed in the dependent claims.

The advantageous embodiments and developments of the invention described above and/or in the dependent claims can be applied here individually or in any combination, except for instance in cases where dependencies are explicit or alternatives cannot be combined.

BRIEF DESCRIPTION OF THE DRAWINGS

The invention and its advantageous embodiments and developments as well as the advantages thereof are described below in greater detail with reference to drawings illustrating exemplary embodiments. These are schematic principle sketches in which.

DETAILED DESCRIPTION OF EXEMPLARY EMBODIMENTS OF THE PRESENT INVENTION

Figure 1:
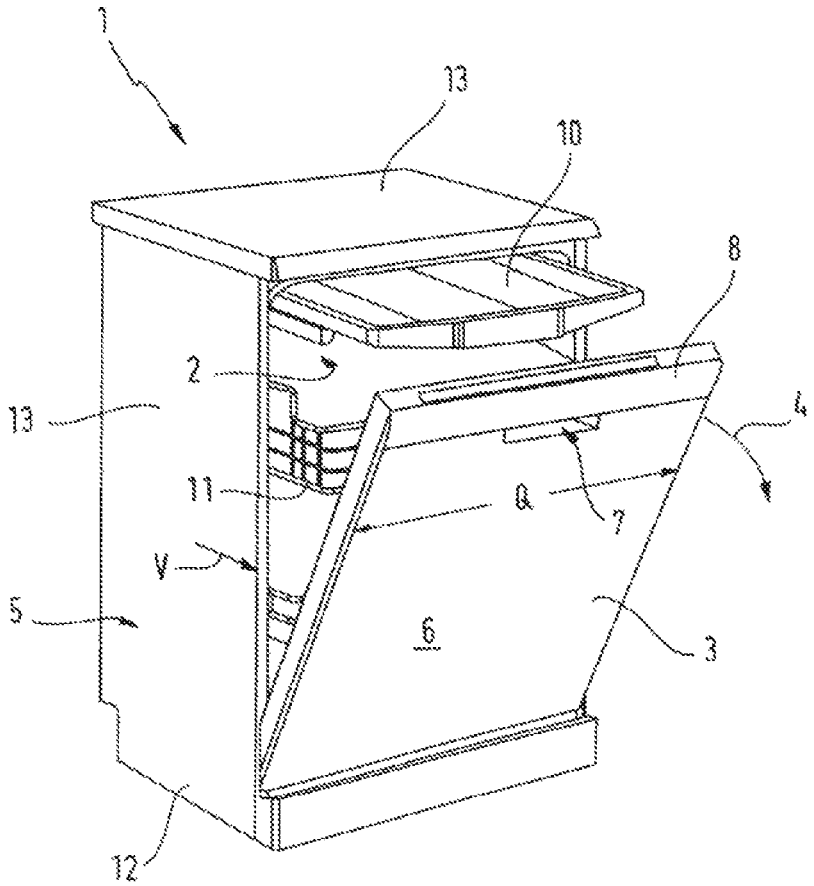
FIG. 1 shows a schematic perspective view obliquely from the front of an embodiment of a household appliance, here for example a dishwasher, in this case having a door on the front side.
Figure 2:
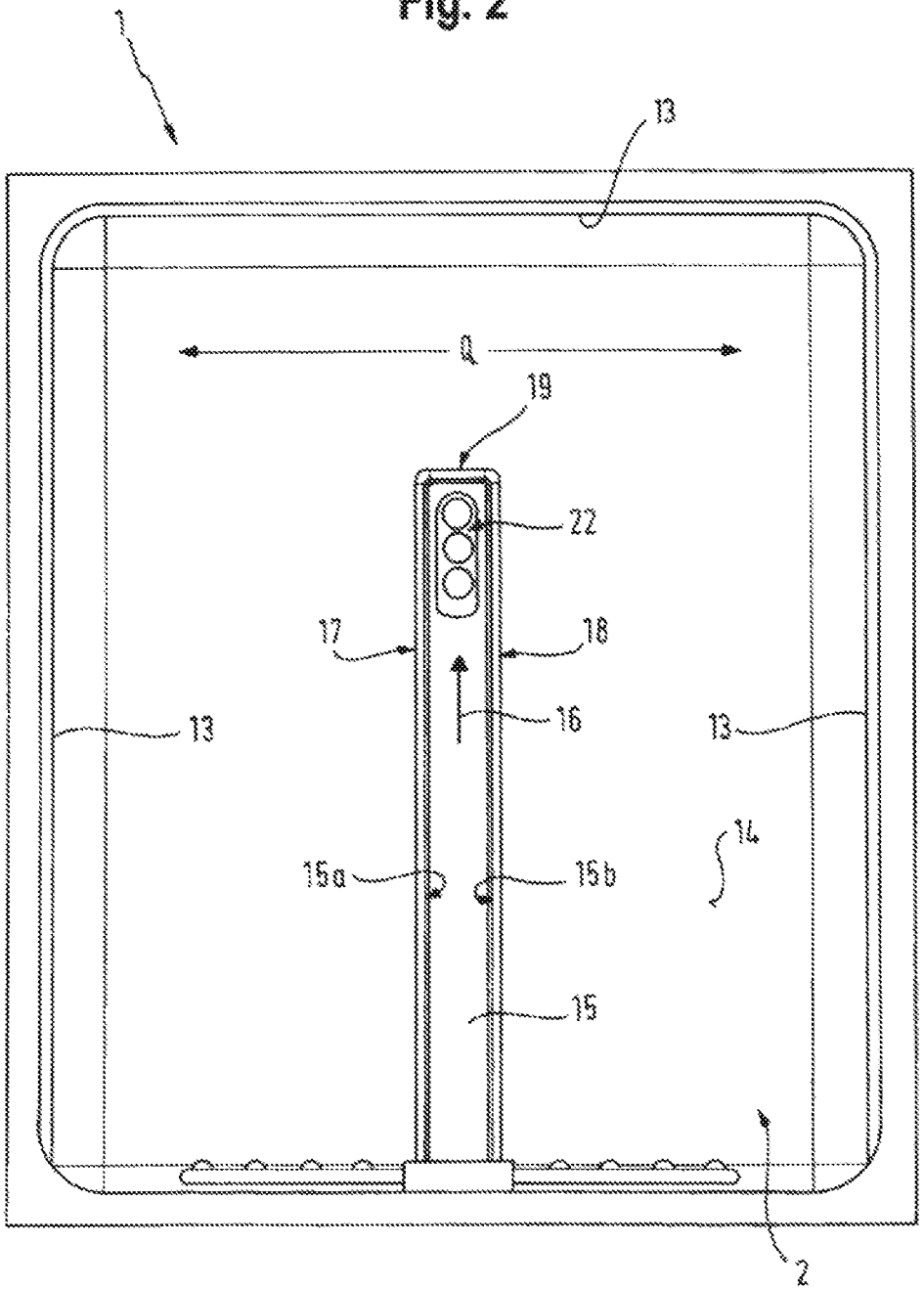
FIG. 2 shows a view from the front side into the dishwasher cavity with a water feed rising symmetrically in the transverse center.

The dishwasher 1 schematically represented in FIG. 1 is a household dishwasher. It has, as an element of an appliance body 5 which is partially open to the outside or closed, a dishwasher cavity 2 for receiving items to be washed such as dishes, pots, cutlery, glasses, cooking utensils and the like. Here, the items to be washed can be stackable for example in baskets 11 and/or a cutlery drawer 10 and what is known as washing liquor or washing fluid can be applicable thereto. Washing liquor is understood here to mean fresh water or in particular water circulating during operation with or without detergent, and/or rinse aid, and/or desiccant. The dishwasher cavity 2 can have an at least essentially rectangular floor plan with a front side V facing toward the user in the operating position. Here, this front side V can form a part of a kitchen front comprising kitchen units arranged side by side, or in the case of a free-standing appliance, can also be unrelated to further units. From the front side V, the dishwasher extends in the transverse direction Q to the left and right. The transverse direction Q thus corresponds to a width direction of the dishwasher. In the transverse direction Q, the dishwasher 1 often has an extent or width of 45, 50 or 60 centimeters. Viewed rearward in the depth direction from the front side V, the extent often also amounts to approximately 60 centimeters. The values are not mandatory.

The dishwasher cavity 2 is closable by means of a door 3, in particular on this front side V. This door 3 is shown in FIG. 1 in a partially open position, in which it is then slanted with respect to the vertical. In its closed position, on the other hand, it stands upright and is pivotable forward and downward about a lower horizontal axis in the direction of the arrow 4 according to the drawing, so that it lies at least almost horizontal in the fully opened position.

On its outer and front side V which is vertical in the closed position and faces toward the user, the door 3 can be provided with a décor panel 6 in order thus to undergo a visual and/or haptic enhancement and/or an adaptation to surrounding kitchen units.

The household appliance, in this case the dishwasher 1, is embodied as a free-standing or what is known as a partly integrated or fully integrated appliance. In the latter case, the appliance body 5 can also close essentially with the outer walls of the dishwasher cavity 2. A housing surrounding the latter on the outside can then be dispensed with. A base 12 for receiving in particular functional elements can be disposed in the lower region of the dishwasher.

In the exemplary embodiment according to the drawing, a control panel 8 extending in the transverse direction Q of the dishwasher is associated with the movable door 3 in its upper region, which control panel 8 can comprise an access opening 7 accessible from the front side V for manually opening and/or closing the door 3.

When the door 3 is closed, the dishwasher cavity 2 is limited circumferentially by four vertical walls 13 and 14 and two horizontal walls 13 in total, of which one forms a ceiling and a further one forms a floor of the dishwasher cavity 2. Disposed opposite the front side V is a rear wall 14, which like the other walls 13 is often made from stainless steel. The rear wall 14 here is self-contained and requires no openings for introducing light or energy into the dishwasher cavity 2.

At least one water feed 15 extends completely or partially in the dishwasher cavity 2 for a water distribution means such as an upper spray arm or one or more individual jets (not shown here) arranged in the upper half of the dishwasher cavity 2. Water feed 15 is understood to mean a feed not only of water but also of washing liquor already specified in more detail above. Furthermore, water distribution means is understood to mean a device for distributing not only water but also more generally washing liquor.

At least one lighting line 17, 18, 19, 20, which can extend over a length of several tens of centimeters, is associated with this fluid-guiding water feed 15 along its guiding direction 16.

Here, the water feed 15 comprises a closed channel 21 extending in certain regions vertically along an upright wall, here the rear wall 14, of the dishwasher cavity 2, in which channel 21 the water or the washing liquor is guided upward. The water feed 15 further comprises a first part 15*c* extending horizontally along the floor 13, in which the channel 21 also initially extends horizontally. This part 15*c* can be provided with first parts of the lighting lines 17, 18 in a similar manner to the upright part.

Both the horizontal and the vertical section of the water feed 15 extend symmetrically in a transverse center of the dishwasher cavity 2, so that an equal amount of space remains between the central water feed and the two side walls 13, which space generally has a transverse extent of significantly less than 30 centimeters. Very little luminous power is therefore sufficient for uniform illumination.

Figure 3:
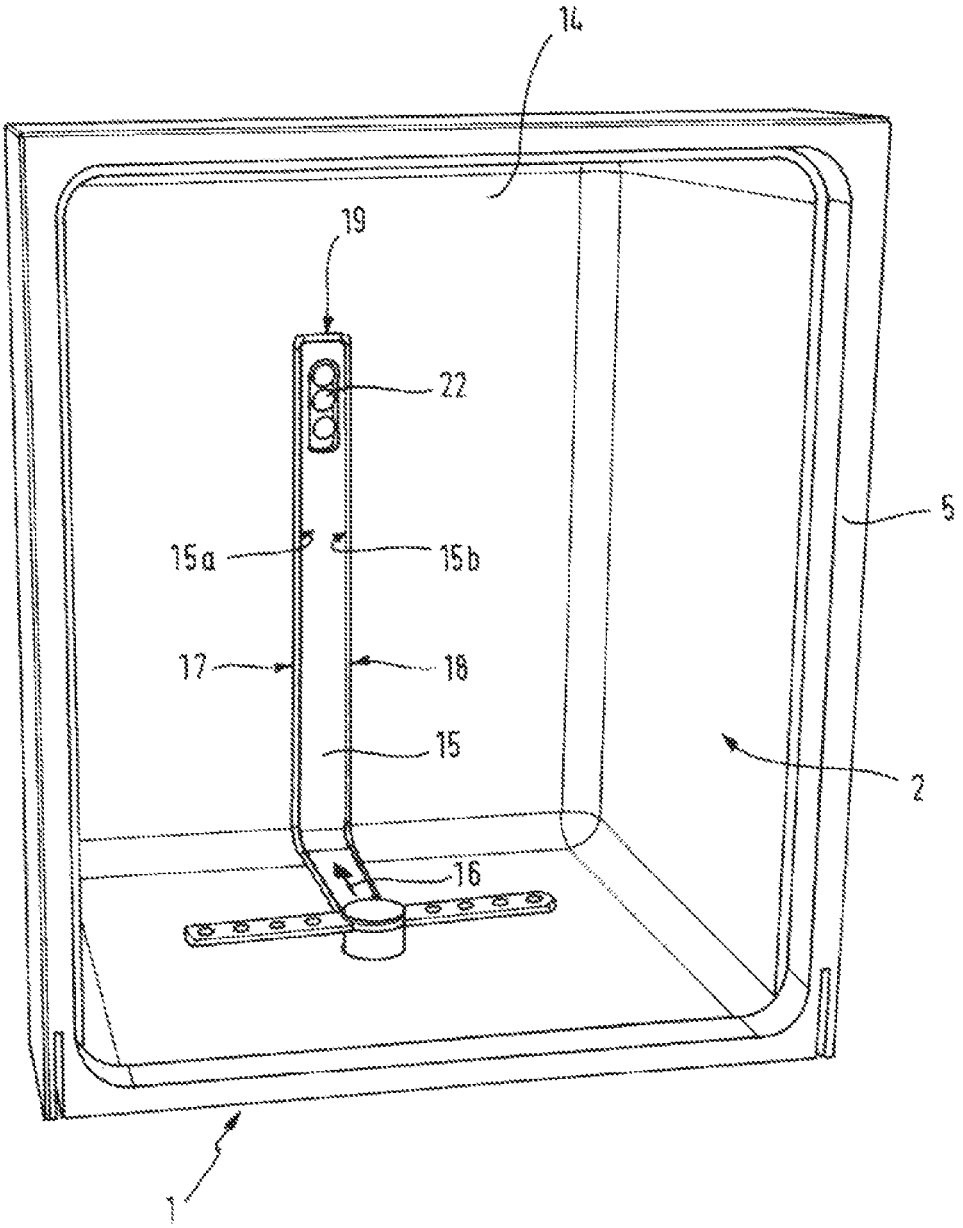
FIG. 3 shows a view similar to that of FIG. 2 but in a perspective view obliquely from above.
Figure 4:
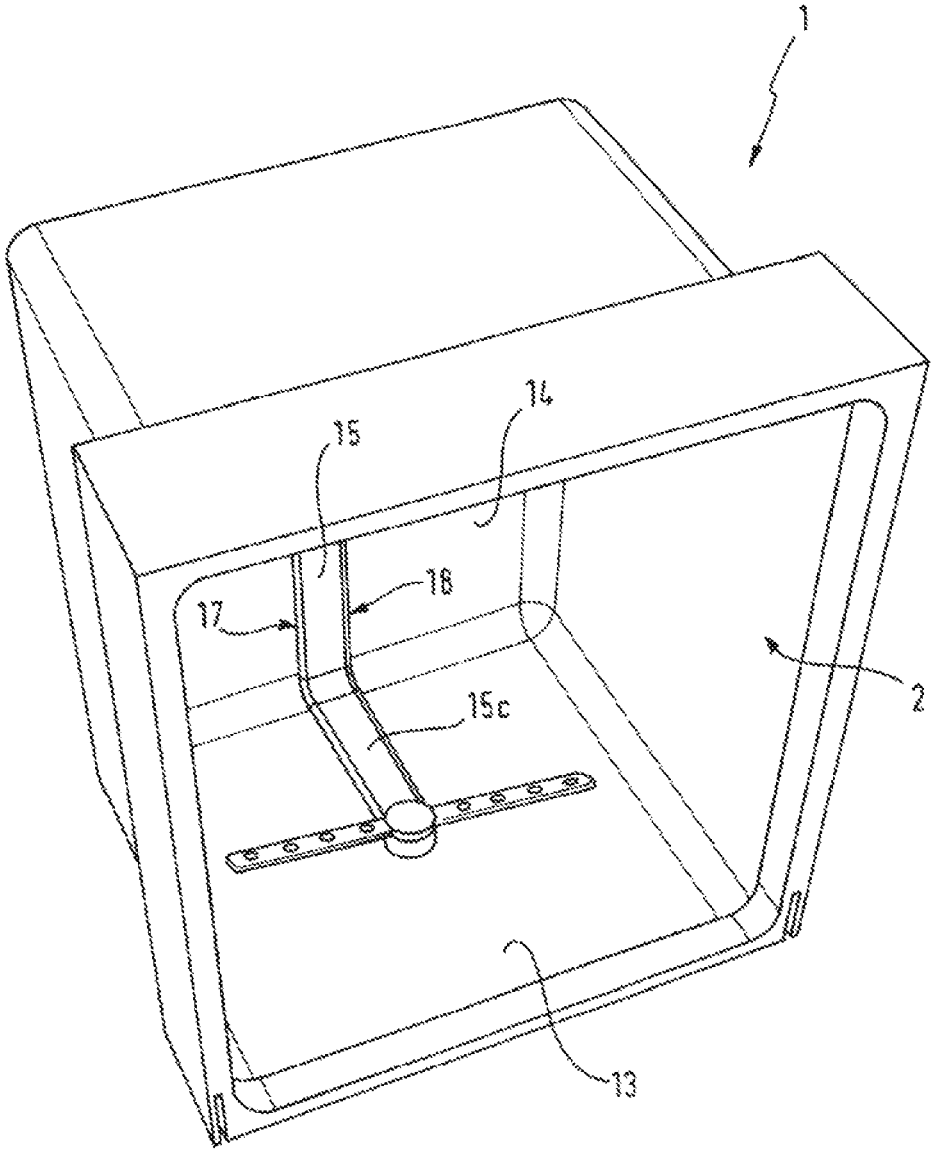
FIG. 4 shows an illustration similar to that of FIG. 3 in a steep perspective view from above.
Figure 5:
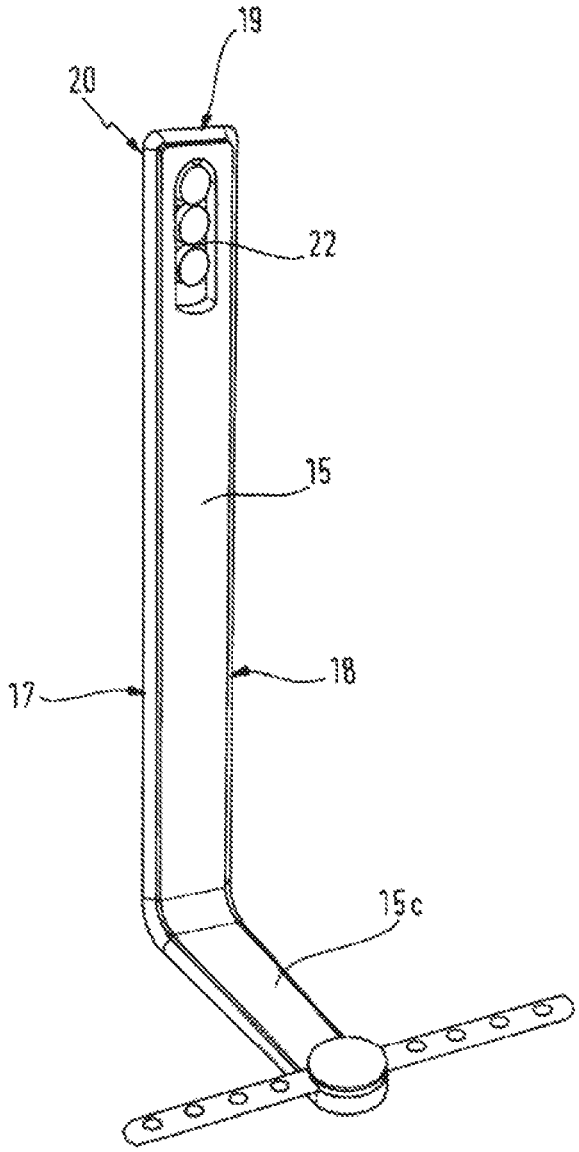
FIG. 5 shows a water feed drawn separately as a single unit.
Figure 6:
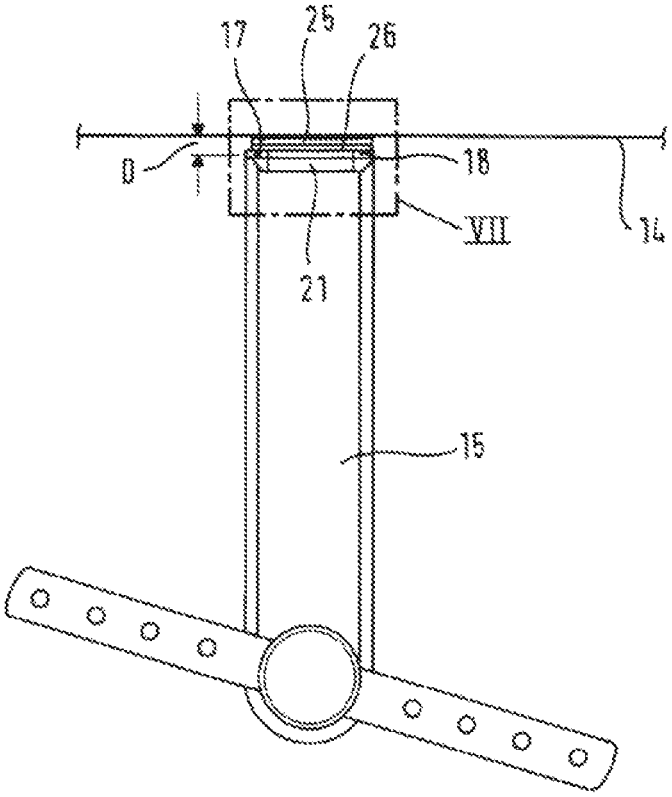
FIG. 6 shows the water feed from FIG. 5 from above.
Figure 7:
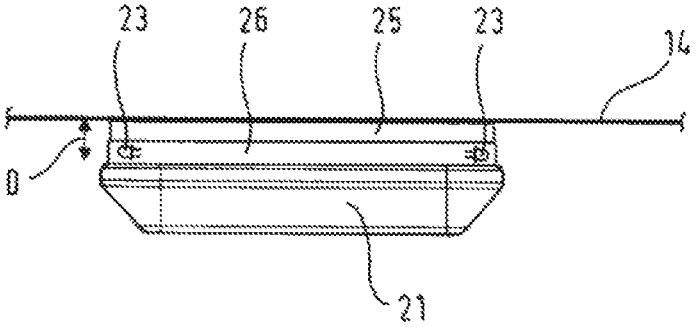
FIG. 7 shows the detail VII in FIG. 6.

The water feed 15 itself has a width of just a few centimeters in the transverse direction Q, although it can be a few tens of centimeters long in the guiding direction 16, as can be seen clearly for example in FIG. 3. In the exemplary embodiment here, a transition 22 into a horizontal feed for an upper spray arm is provided at the upper end.

According to the drawing, two lateral lighting lines 17, 18 are arranged on two opposing sides 15*a*, 15*b* of the water feed 15, thus running parallel to the longitudinal extent of the water feed 15 and radiating light toward the transverse sides in the transverse direction Q.

Here, said lateral lighting lines 17, 18 are connected to one another above the transition 22 via an upper terminating line 19, which can be embodied in principle in the same manner as the lateral lighting lines 17, 18 and here at least in its central region radiates light upward onto the ceiling 13 of the dishwasher cavity 2.

Depending on the embodiment of the upper end of the water feed 15, the upper terminating line does not have to extend in a straight line but can also extend in a curved shape.

In this way, the lateral lighting lines 17, 18 and the upper terminating line 19 can together form a common, complete lighting line 20 surrounding the water feed in certain regions. Here, this continuous line 20 has the shape of an inverted U. Alternatively, for example, the upper terminating line 19 can also be omitted. In this case, only the two parallel lateral lighting lines 17, 18 are present.

The embodiment of the respective lighting lines 17, 18, 19, 20 can vary. To obtain a light yield which is as uniform as possible over the extent while minimizing the installation space required, at least one of the lighting lines comprises a plurality of LED light sources 23, or comprises in total one light guide which also radiates light to the side. The light source(s) 23 radiate light to the left and right into the dishwasher cavity 2, the light is reflected by the stainless-steel walls 13, 14 of the dishwasher cavity 2 and is thus distributed uniformly.

In an LED embodiment, the color of the lighting lines 17, 18, 19 20 can be individually selectable by the respective customer, so that an additionally enhanced quality impression for the customer is produced.

Figures 8, 9:
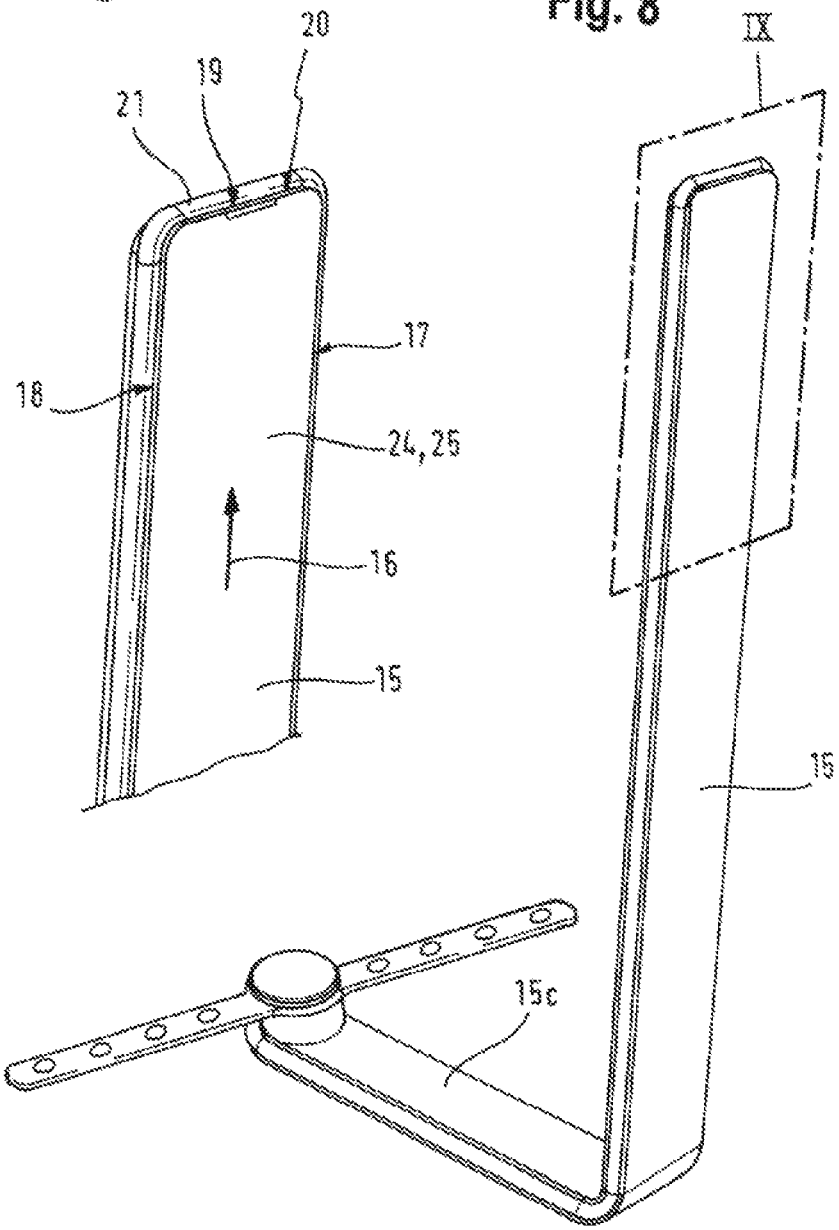
FIG. 8 shows the water feed obliquely from behind prior to its installation.
FIG. 9 shows the detail IX in FIG. 8.

For a highly integrated and simple construction and for a minimal installation space, the lighting line(s) 17, 18, 19, 20 is or are arranged in an intermediate space between the channel 21 and a wall, here the rear wall 14, of the dishwasher cavity 2. This means that the channel 21 itself extends at a horizontal distance D from the rear wall 14 (or at a vertical distance D from the floor 13). The distance D can amount to approximately 8 to 25 millimeters, for example. However, the unit of the water feed 15 overall extends continuously up to the rear wall 14. As can be seen clearly from FIG. 9, the unit of the water feed 15 is constructed in such a way that on its contact side 24 with the rear wall 14 initially a plastic part 26 is molded on toward the rear. The lighting lines 17, 18 are arranged in this plastic part 26 on the outer side with respect to the transverse direction Q. To this end, the plastic part here in the exemplary embodiment is preferably embodied as an insertion shaft, which is sealed in a watertight manner by a closing cover or a closing cap 25. With its rear wall surface 24, the water feed device 15 rests preferably flush, in other words without a gap, on the rear wall 14 of the dishwasher cavity. To the front, in the direction toward the front side V, the channel 21 which is wider in the transverse direction Q is connected such that the lighting line(s) 17, 18 itself or themselves is or are hidden by the channel 21. The plastic part 26 is preferably formed from a transparent, in particular milky transparent plastic. The light source(s) can extend over the entire longitudinal extent of the water feed 15 from the sump via the horizontal part 15*c* to its upper end above the transition or coupling device 22 for the upper water distribution means, such as an upper spray arm. The (milky) transparent plastic can act as a diffusor and support uniform illumination without individual light sources 23, for example light-emitting diodes, becoming visible.

Alternatively, the plastic part 26 can also be embodied solid, and the two lighting lines can then expediently be cast into the plastic part 26.

The lighting line(s) 17, 18, 19 are thus arranged in a watertight plastic body 26, which depending on the embodiment is either box-shaped and sealed off to the outside, for example by the cover cap 25, or which overall embodies or can contain a casting compound for the lighting line(s) 17, 18 19, 20. It is also possible for the plastic part 26 to be manufactured in a dual injection method jointly with the channel 21 in order to simplify manufacturing. In all cases, a high integration and long-term reliability of the lighting is ensured without restricting the fluid-guiding function. The channel 21 can be either manufactured jointly or at least pre-assembled jointly with the plastic body 26 and inserted as a common unit into the dishwasher cavity 2.

In the fully assembled state of the dishwasher, the light guide or the light cord or the like is preferably connected to the plastic part 26 of the water feed 15. The entire unit comprising the channel 21 and the plastic part 26 can already be completed outside of the assembly line of the dishwasher 1 and mounted as a common unit in the dishwasher cavity 2 with minimal mounting effort. Both the mounting and a possible later replacement by customer service are thereby simplified.

The energy supply can likewise be routed via the interface to the water feed 15. As a result, no additional interfaces are required.

Because the channel 21 covers the light source(s) 23 of the lighting lines 17, 18, 19, 20 toward the front, the latter is or are not itself or themselves visible. An indirect light is thus produced, which does not dazzle the customer looking from the front side V in the direction of the rear wall 14.

Where applicable, it can also be expedient if, instead of the one or more lighting lines such as 17, 18, a lighting device with a spatial-geometric shape which differs from a line is associated with the water feed, in particular is attached thereto. In this way, the lighting device can be provided for example in the form of a flat, for example circular or rectangular lighting panel at a height position on the upward water feed disposed in the vacant gap between a lower basket provided close to the dishwasher cavity floor and an upper basket arranged further up in the dishwasher cavity at a vertical distance from the lower basket. According to a further advantageous variant, the lighting device can form an illuminated surface section on the upper side of the water feed which is visible to the user. In particular, the lighting device can form an illuminated surface section on the front side which is directly visible from the front on the vertically extending section of the upward water feed.

The invention claimed is:

1. A dishwasher, comprising:

a dishwasher cavity configured to receive an item to be washed;

a water feed extending completely or partially in the dishwasher cavity for providing a water distribution in the dishwasher cavity; and a lighting device associated with the water feed, wherein the water feed comprises a closed channel extending at least on one region vertically upward along a rear wall of the dishwasher cavity for guidance of washing fluid to the water distribution, wherein the water feed extends symmetrically in a transverse center of the dishwasher cavity at least along the rear wall, so that an equal amount of space remains between left and right vertical sides of the water feed and left and right side walls of the dishwasher cavity, respectively, wherein the lighting device comprises two lateral lighting lines arranged symmetrically on the left and right vertical sides of the water feed and arranged between the closed channel and the rear wall of the dishwasher cavity at a distance from the rear wall, and wherein the two lateral lighting lines are hidden by the closed channel, so as to produce an indirect light on condition that the dishwasher cavity is viewed from a front side in a direction of the rear wall.

2. The dishwasher of claim 1, constructed in the form of a household dishwasher.

3. The dishwasher of claim 1, wherein the water distribution is arranged in an upper half of the dishwasher cavity.

4. The dishwasher of claim 1, wherein the two lateral lighting lines radiate light transversely toward the left and right vertical sides of the water feed.

5. The dishwasher of claim 1, wherein the lighting device includes an upper terminating line to connect the two lateral lighting lines to one another above the water distribution.

6. The dishwasher of claim 5, wherein the upper terminating line has at least one region to radiate light upward.

7. The dishwasher of claim 5, wherein the two lateral lighting lines and the upper terminating line together form a common, complete lighting line having at least one region in surrounding relationship to the water feed.

8. The dishwasher of claim 1, wherein the two lateral lighting lines comprise a plurality of LED light sources.

9. The dishwasher of claim 1, wherein the two lateral lighting lines comprise a light guide.

10. The dishwasher of claim 1, wherein the two lateral lighting lines have a color which is individually selectable.

11. The dishwasher of claim 1, further comprising a watertight plastic body, the two lateral lighting lines being arranged in the watertight plastic body.

12. The dishwasher of claim 1, wherein the two lateral lighting lines are cast in a plastic material which is resistant to washing liquor.

* * * * *